US005745025A

United States Patent [19]

Reuss

[11] Patent Number: 5,745,025

[45] Date of Patent: Apr. 28, 1998

[54] SNAP-ENGAGING APPARATUS FOR A ROTABLE COMPONENT

[75] Inventor: Oswald Reuss, Unterelsbach, Germany

[73] Assignee: Preh-Werke GmbH & Co. KG, Bad Neustadt, Germany

[21] Appl. No.: 592,683

[22] Filed: Jan. 26, 1996

[30] Foreign Application Priority Data

Feb. 3, 1995 [DE] Germany ..... 295 01 692 U

[51] Int. Cl.[6] ..... H01C 10/32

[52] U.S. Cl. ..... 338/167; 338/152; 338/162; 338/173; 200/443

[58] Field of Search ..... 338/152, 162, 338/163, 166–170, 171, 172, 173, 198, 149, 98; 200/43.03, 443

[56] References Cited

U.S. PATENT DOCUMENTS

| | | | |
|---|---|---|---|
| 2,396,970 | 3/1946 | Riling | 338/168 |
| 2,631,212 | 3/1953 | Lindsay et al. | 338/167 |
| 2,632,830 | 3/1953 | Aust et al. . | |
| 2,980,770 | 4/1961 | Nabstedt . | |
| 3,579,169 | 5/1971 | Dickinson | 338/170 |
| 3,643,044 | 2/1972 | Batchller | 200/43.03 |
| 3,973,094 | 8/1976 | Kuhn | 200/443 |
| 5,187,464 | 2/1993 | Forgacs | 338/149 |

FOREIGN PATENT DOCUMENTS

| | | |
|---|---|---|
| 994452 | 11/1951 | France . |
| 2694 126 A1 | 1/1994 | France . |
| 27 55 999 | 6/1978 | Germany . |
| 27 35 352 | 2/1979 | Germany . |
| 28 24 584 A 1 | 12/1979 | Germany . |
| 31 39 094 C2 | 6/1982 | Germany . |
| 36 37 597 A1 | 5/1987 | Germany . |
| 40 35 011 A1 | 5/1992 | Germany . |

OTHER PUBLICATIONS

*Bauelement der Feinmechanik* (Components of Precision Mechanics); by O. Ritcher and R.v.Voss; Sixth Edition; pp. 266 and 267; Fig.

*Primary Examiner*—Tu B. Hoang

*Attorney, Agent, or Firm*—Griffin, Butler Whisenhunt & Szipl

[57] ABSTRACT

A snap-engaging apparatus for use in a rotatable electrical component, particularly a rotatable switch or a rotatable resistor, makes it easier to find operational positions. The snap-engaging apparatus includes a rotor (3) which is formed as a hollow body to have an axial opening and a radial, or circumferential, wall (7). A leaf spring (8) is tensioned to have a U-shape with its ends (9, 11) being self supported against diametrically positioned parts of the circumferential wall (7). A snap-engaging contour wall surface (19) coaxially surrounds the rotor, with a snap-engaging nose (15), formed on an extension (14) of one end of the leaf spring, being springingly urged thereagainst in a radial direction. The circumferential wall (7) has an opening (17) through which the snap-engaging nose (15) extends.

6 Claims, 3 Drawing Sheets

SNAP-ENGAGING APPARATUS FOR A ROTABLE COMPONENT

BACKGROUND OF THE INVENTION

This invention concerns a snap-engaging apparatus for use in a rotatable electrical component, particularly in rotatable switches or rotatable resistors, of a type having an engaging nose which is flexibly held by a leaf spring in engagement with a rotatable rotor of the component, and having a stationary engagement contour wall of the component, with which the engaging nose is snapped, or engaged, by the leaf spring.

Such a snap-engaging apparatus makes it easier to find operational positions by providing tactile as well as acoustical feedback during rotational adjustments. Particularly for resistors, such snap-engaging apparatus allow one to sense their adjustments and thereby be conscious of their positions.

A snapping structure of a snap-engaging apparatus basically includes an elastically held snapping protrusion, a short engaging nose, and one or more adjacent depressions which are in a cooperating snap-engaging contour wall for cooperating with the engaging nose. One of the two engaging structures, the engaging nose or the engaging contour wall, is affixed to an adjustable member of the concerned component. The respective other engaging structure is, contrary thereto, held stationary on the component. The two snap-engaging structures, which are biased against one another by a spring element, slide over one another during a rotatable adjustment. Thus, the snap-engaging structures create tactile engagement points.

A rotatable resistor is shown in German Patent DE 31 39 094 A1 having snap-engaging structures acting radially to a rotational axis. In these structures, a spring engaging nose is held stationary and an engaging contour wall is rotatable.

Further, rotatable resistors are known having snap-engaging structures which are arranged to act coaxially with rotational axes. In some of these rotatable resistors spring engagement noses are likewise held stationary and engagement contour wall surfaces are rotatable (German Patent DE 27 35 352 A1, and U.S. Pat. No. 2,632,830). In other rotatable resistors, spring engagement noses are rotatable and engagement contour wall surfaces are stationary (German Patent DE 2 755 999 and German Patent DE 36 37 597 A1).

German Patent DE 40 35 011 A1 describes a snap-engaging apparatus of a rotatable switch. In this structure a rotatable magnetic ring having poles with changing polarity is positioned opposite a low-retentivity (soft magnetic) stator having pole pieces. In a snap-engagement apparatus described in the book *Bauelement der Feinmechanik* (Translated into English: *Components of Precision Mechanics*), published by Verlag Technik Berlin, Sixth Edition, FIG. 1139, a snap-engaging apparatus has a leaf spring as a spring element. An engagement nose is formed at an end of the leaf spring which cooperates with an engaging contour wall.

It is an object of this invention to provide a snap-engaging apparatus for use in a rotatable electrical component having an engagement nose which is flexibly held by a spring element in flexible engagement with a rotor which can be moved about its axis, the engaging nose being held in snapping engagement with an engagement contour wall of the component by the spring element, with the spring element allowing a large spring-movement path of the engagement nose relative to a structural size of the snap-engaging apparatus.

SUMMARY

According to principles of this invention a snap-engaging apparatus for use in a rotatable electrical component comprises a hollow rotor having an axial opening and a circumferential wall, a leaf spring which is tensioned to have substantially a U-shape with first and second ends thereof being self-supported on diametrically-positioned portions of the circumferential wall, and an engagement contour wall coaxially surrounding the rotor and the rotor axis. The engaging nose flexibly engages, radially to the rotor axis, the contour wall. The circumferential wall of the rotor has an opening therein through which the engaging nose, which is formed on an extension of the leaf spring, extends.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
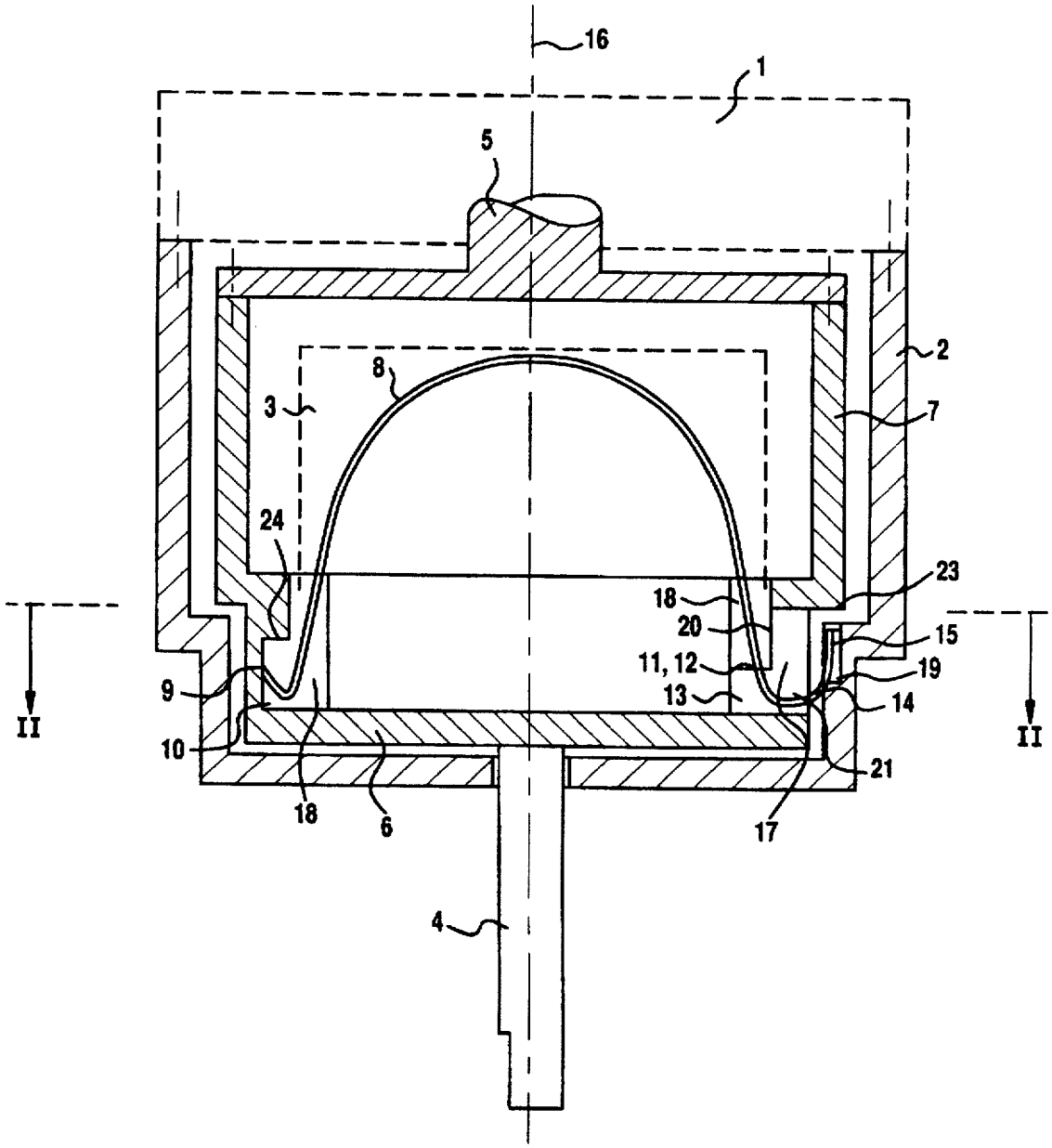
FIG. 1 is an axial cross-sectional view of a snap-engaging apparatus of this invention.

FIG. 1 shows a driving end of a rotatable component having a snap-engaging apparatus integrated therewith. The component 1, itself, is simplified in the drawing so as to only be representative.

A rotor 3 is positioned in a housing 2. The rotor 3 can be rotated by means of an adjusting shaft 4. The rotor 3 and the adjusting shaft 4 are rotatably mounted in the housing 2. The rotor 3 supports a coupling part 5 extending to the component 1 to transmit adjusting movement to the component. Other possibilities of snap-engaging apparatus can be imagined in which the rotor 3 directly adjusts the component 1. The rotor 3 is primarily a hollow cylinder having a cylinder floor 6 and a stepped cylinder wall 7. The rotor 3, itself, is open in the direction of the component 1; with, in this example, the mounted coupling part 5 covering the opening of the rotor 3. A leaf spring 8 is tensioned in the interior of the rotor 3, between the leaf spring's ends, by diametrically positioned parts of the cylinder wall 7 in such a way that the spring's form is substantially like that of an inverted U. In this example, the U bow extends toward the component 1.

Figure 3A:
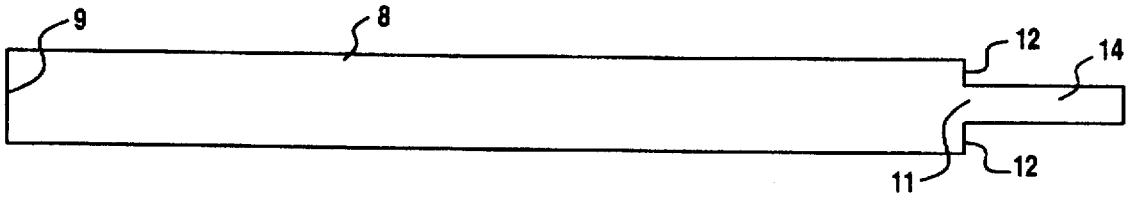
FIG. 3*a* is a plan view of a punched-out, or stamped, leaf spring of the snap-engaging apparatus of FIGS. 1 and 2.
Figure 3B:
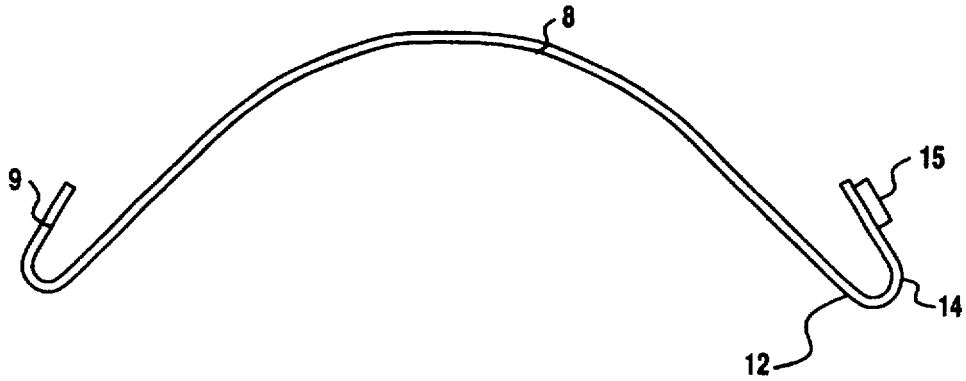
FIG. 3*b* is a side view of the leaf spring of FIG. 3*a* in its bent form.

The leaf spring 8 has a blunt cut end 9 (see FIG. 3*a*), which is bent back towards the outside of the leaf spring 8 to lie in an indentation 10 of the cylinder wall 7. An opposite end 11 of the leaf spring 8 is formed to have symmetrically cut support shoulders 12 which can prop, or push, against a divided, step-like, ledge 13. The leaf spring 8 has an extension 14 which extends outwardly between the support shoulders 12. A snap-engaging nose 15 is on the extension 14. The extension 14 is bent back toward the rest of the leaf spring 8 only so far that when the snap-engaging nose 15 is mounted, the support shoulders 12 are positioned to spring radially to a rotation axis 16 of the rotor 3. The extension 14 extends through a window like opening 17 in the cylinder wall 7, sufficiently far that the snap-engaging nose 15 extends outside the cylinder wall 7.

The leaf spring 8, guided laterally by ribs 18 at its end areas, is exactly positioned laterally so that it cannot move laterally. Thus, the extension 14 has controlled movement in the opening 17; the opening 17 being from ¼ to ½ of a tooth-like snap-engaging depression portion of a snap-engaging contour wall 19 (see FIG. 2) wider than the width of the extension 14. The leaf spring 8 is free of engagement between its end portions 9 and 11. The leaf spring 8 is assured against falling out of its desired position by stop surfaces 23, 24.

A snap-engaging contour wall surface is worked into the snap-engaging contour wall of the housing 2. The snap-engaging contour wall surface comprises a linear series of the tooth-like snap-engaging depressions, which are not shown in detail. When mounted, the snap-engaging contour wall surface 19 of the snap-engaging contour wall is positioned adjacent the snap-engaging nose 15, which engages in the respective oppositely positioned snap-engaging depressions. The support shoulders 12 spring radially inwardly as the snap-engaging nose 15 slides over the snap-engaging contour wall surface 19 so that a spacing is developed between the support shoulders 12 and an interior surface 20 of the rotor 3. If the rotor 3 is removed from the housing 2, the support shoulders 12 lie against the interior surface 20 of the rotor.

Figure 2:
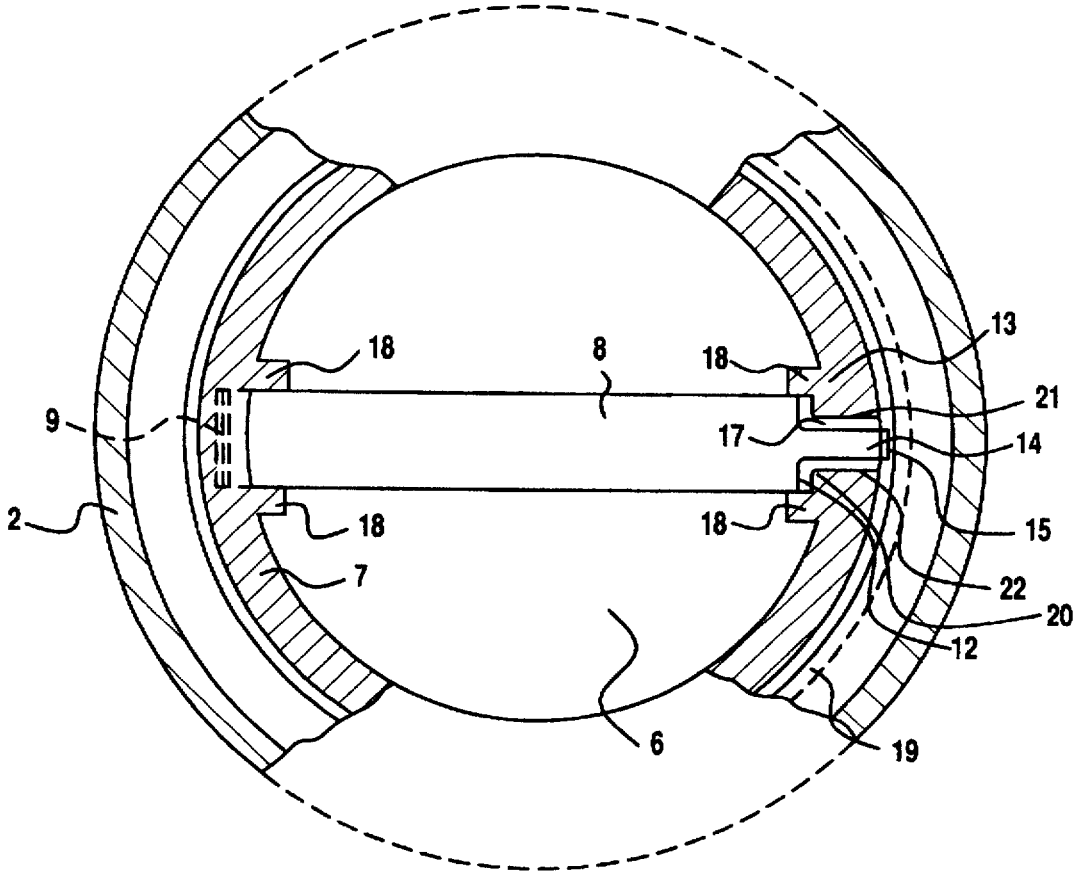
FIG. 2 is a cross-sectional view taken on line II—II of FIG. 1.

During a rotation adjustment, for example in a counter-clockwise direction, clockwise as shown in FIG. 2, the extension 14, which is guided in a less precise manner, is first distorted (twisted) when shoved by a sidewall 21 defining the opening 17. Upon engagement of the snap-engaging nose in a depression of the snap-engaging contour wall 19, the extension 14 momentarily relaxes and contacts an oppositely positioned sidewall 22. This contact can be heard. This acoustical manifestation can be amplified by sound boxes which can be built into the arrangement of the device.

It is a benefit of the invention that the leaf spring with the snap-engaging nose built thereon can be self guidingly mounted in the snap-engaging apparatus so as to be self supporting. A further benefit is the improved acoustical signal provided by the snap-engaging apparatus during a rotatable adjustment. In this regard, the narrower extension of the leaf spring is, during a rotatable adjustment, tensioned against the pushing sidewall, or side edge, defining the cooperating opening. During a snapping of the snap-engaging nose, the extension momentarily relaxes and hits against the opposite, in a rotational direction, side edge defining the opening.

The spring element used for this invention allows a relatively large spring stroke of the snap-engaging nose relative to sizes of the various components.

By means of this invention the snap-engaging apparatus can be more easily heard so that an easier adjustment is achieved.

While the invention has been particularly shown and described with reference to a preferred embodiment, it will be understood by those of ordinary skill in the art that various changes in form and detail may be made therein without departing from the spirit and scope of the invention.

The invention claimed is:

1. A snap-engaging apparatus for use in a rotatable electrical component having a snap-engaging nose which is flexibly held by a leaf spring in engagement with a rotor which can be rotated about its axis, and a stationary engagement contour wall of the component, with the snap-engaging nose being snapped into engagement with the engagement contour wall by the leaf spring;

wherein the rotor is a hollow body having an axial opening and a circumferential wall, the leaf spring is tensioned to have substantially a U-shape, with first and second ends thereof being self supported on diametrically-positioned portions of the circumferential wall, the engagement contour wall coaxially surrounding the rotor and the rotor axis, the circumferential wall having an opening therein through which the snap-engaging nose, which is formed on an extension of the leaf spring, extends to flexibly engage, radially to the rotor axis, the engagement contour wall.

2. Snap-engaging apparatus as in claim 1 wherein at least one end of the leaf spring has notches for forming shoulders thereon which serve to provide an exact support against the circumferential wall.

3. Snap-engaging apparatus as in claim 1 wherein the leaf spring is long and narrow in width but wherein the extension has a width which is narrower than a middle portion of the leaf spring.

4. Snap-engaging apparatus as in claim 1 wherein said leaf spring is long and narrow with the extension being at an end thereof and wherein the extension is bent back toward a middle portion of the leaf spring so that the bent back portion of the extension forms the snap-engaging nose which in a mounted configuration extends substantially radially outwardly from the rotor axis.

5. Snap-engaging apparatus as in claim 4 wherein the snap-engaging nose and a plane of flexure of the extension are axially spaced from one another.

6. Snap-engaging apparatus as in claim 1 wherein the engagement contour wall has series of tooth-like snap-engaging depressions for snapping with the snap-engaging nose and wherein the width of the opening in said circumferential wall is wider than the extension by a range of from ¼ to ½ of a width of a tooth-like snap-engaging depressions.

* * * * *